United States Patent [19]

Wojcik

[11] 4,194,292

[45] Mar. 25, 1980

[54] DRAWING INSTRUMENT

[76] Inventor: Tadeusz P. Wojcik, 4 Ncilwrith Crescent, Guelph, Ontario, Canada, NIE 6J2

[21] Appl. No.: 859,170

[22] Filed: Dec. 9, 1977

[51] Int. Cl.[2] ..... B43I 11/04

[52] U.S. Cl. ..... 33/30 C

[58] Field of Search ..... 33/27K, 30 R, 30 C

[56] References Cited

U.S. PATENT DOCUMENTS

| | | | |
|---|---|---|---|
| 1,026,560 | 5/1912 | Burke | 33/30 C |
| 2,496,614 | 2/1950 | Arnason | 33/27 K |
| 3,719,996 | 3/1973 | Filho | 33/30 C |

FOREIGN PATENT DOCUMENTS

| | | | |
|---|---|---|---|
| 196682 | 3/1908 | Fed. Rep. of Germany | 33/30 C |
| 603712 | 6/1933 | Fed. Rep. of Germany | 33/30 C |

*Primary Examiner*—Harry N. Haroian

[57] ABSTRACT

A vertical post extends through the center of an enlarged central opening in an annular circular disc. Manually adjustable mechanisms removably secure the disc to the post in such manner as to permit the angle between the plane of the disc and the axis of the post to be set at any value between −X and X, where X as expressed in degrees can range between 0 and somewhat less than 180. A first elongated vertical member with a semicircularly shaped central section has upper and lower horizontally elongated hollow tracks extending in the same direction and coplanar with the section. The post passes through the tracks and section with clearance so that the member can be moved vertically up and down with respect to the post and also can be rotated around the post. A second elongated vertical member has a straight vertical central section provided with a guide mechanism engageable with an disengageable from the periphery of the disc. The second member has parallel horizontal upper and lower rails at corresponding upper and lower ends of the straight section. Each of the rails slidably engages a corresponding one of the tracks and is horizontally movable therein. A marker device slidably engages the lower rail and is securable thereto.

7 Claims, 5 Drawing Figures

DRAWING INSTRUMENT

PRIOR ART STATEMENT

Two U.S. Pat. Nos. 1,406,863 and 2,496,614, as well as two German Pat. Nos. 603,712 and 483,720, disclose devices for drawing ellipses which differ in structure from the present invention, cannot be used as easily, are more complicated to construct and utilize different principles of operation.

SUMMARY OF THE INVENTION

This invention is directed toward a manually operable drawing instrument which can be used to draw arches and ellipses quickly, easily and with great accuracy.

To this end, two bottom disposed pins extend vertically downward from a block supporting the bottom end of a vertical post. These pins can engage a horizontal sheet of paper supported on a suitable horizontal surface. The post passes through the center of the central opening in an annular circular disc.

Manually adjustable means removably secures the disc to the post and enables the angle between the plane of the disc and the axis of the post to be set at any value between $-X$ and X, where X as expressed in degrees can range between 0 and somewhat less than 180.

A first elongated vertical member has a central section in the form of a semicircle with horizontally elongated upper and lower hollow tracks at corresponding upper and lower ends of this section which extend in the same direction and are coplanar with this section. The post passes through the ends and tracks with clearance whereby the member can be rotated around the post and moved vertically up and down along the post.

A second vertically elongated member has a straight vertical central section provided with a guide mechanism engagable with and disengagable from the periphery of the disc. The second member has parallel horizontal upper and lower rails at corresponding upper and lower ends of the straight section, each of the rails slidably engaging a corresponding one of the tracks and being horizontally movable in the corresponding tracks. Marker means slidably engages the lower rail is securably thereto.

When the disc is in place, the post is held in position and the two members are squeezed together and rotated about the post, the guide mechanism engaging the disc periphery. If the disc is horizontal, a circle is drawn on the paper. If the disc is inclined, an ellipse is drawn. Since the members can move together up or down, radially and horizontally with respect to the post, irregularities in the paper surface cannot adversely influence the accuracy of the drawing. Larger circles can be drawn when the disc is removed.

The invention is explained in more detail below.

DETAILED DESCRIPTION OF PREFERRED EMBODIMENTS

Figure 1:
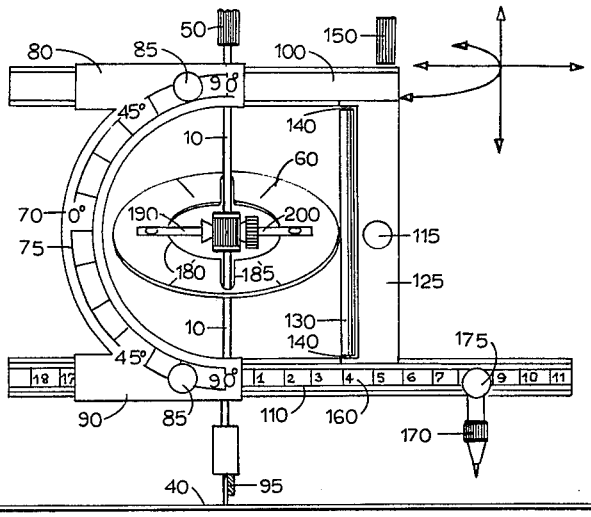
FIG. 1 is a side view of the invention.
Figure 2:
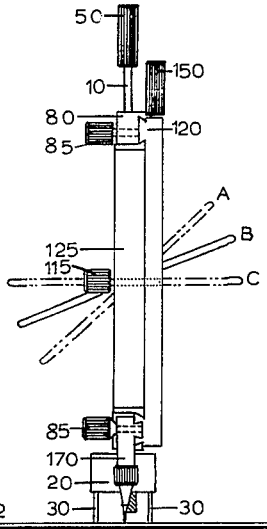
FIG. 2 is an end view of the invention.
Figure 3:
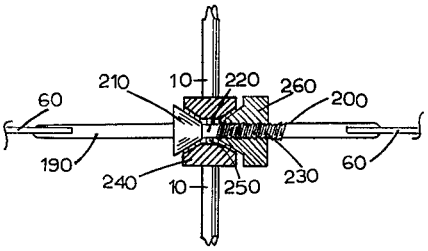
FIG. 3 is a detail view of certain parts used in the invention.
Figure 4:
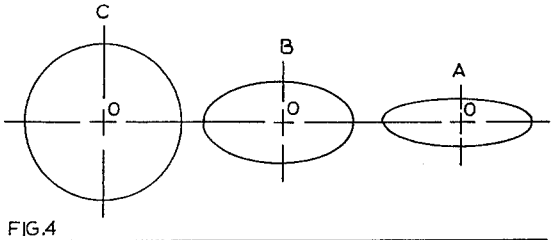
FIG. 4 illustrates circles and ellipses as drawn using the invention.

Referring now to FIGS. 1–5, a thin vertical semicircular member 70 has upper and lower coplanar horizontally elongated parallel hollow tracks 80 and 90 which extend in the same direction. These tracks have internal ribs or grooves which assist in holding rails slidably therein. There are upper and lower horizontally elongated rails 100 and 110 which can be locked into desired positions by locking screws having enlarged knobs 85. Rails 100 and 110 are interconnected by a vertically elongated member 120 which connects one end of rail 100 to rail 110 at a point intermediate the ends of rail 110.

A vertical rod or post 10 has an elongated knob 50 at its top end and is connected at its bottom end in a vertical block 20. Two parallel vertical like pins 30 extend downward from the block. A screw 95 can be tightened or loosened against the bottom of track 90 locking the track in place for positioning of the disc or loosened to allow the tracks to be moved up and down with respect to post 10. The post passes downwardly through vertical aligned bores in tracks 80 and 90 at the points where these tracks connect with semicircular member 70.

The rails 100 and 110 are relatively thin so that the post 10 passes along side of the outer edges, and the rails are confined between the post and the side of the tracks adjacent knobs 85. Thus by loosening knobs 85, 95 "the entire arrangement of tracks and rails" can be moved in three dimensional space relative to the post and when knobs 85 are tightened, the arrangement can move up, down or rotate about the axis of the post. If knob 95 is also tightened, the arrangement is fixed and in proper position for the disc 60 to use scale 75 to obtain desired angle of disc rotation.

Rail 110 has a horizontally elongated groove 160 in its outer surface in which a marker unit 170 is slidably disposed. A locking screw controlled by knob 175 allows the unit to be locked in position along the groove at any point desired. The unit has a downwardly extending lead or pen point so as to enable a line to be drawn as will be explained below.

A vertical knob 150 extends from above the rail 100 into the top portion of member 120. A vertically elongated roller 130 or other like element has oppositely disposed vertically aligned pegs 140 held in holder 125 whereby the roller is pivotable or rotatable about its axis. Locking screw with enlarged knob 115 secures holder 125 to member 120.

Member 70 carries angular calibrations 75, shown in degrees (but of course can be otherwise calibrated as for example in radians) with a 0 position designating the horizontal and disposed at the center of the calibration scale.

Post 10 passes through the center of a circular annular flat horizontal disc 60. This center is an enlarged circular opening 180 centered on the axis of the disc. Two diametrically opposed and radially inwardly extending bars 200 and 190 each have slots at opposite ends wich receive the inner periphery of the disc, these bars forming part of an integral structure having conical portion 210, cylindrical portion 220, and a threaded portion between bars 190 and 200, going from right to left. A block 240 has a horizontal central bore 250 with flared ends. Portion 220 is disposed entirely within the bore. The post 10 is secured to the block and engages the bore. It is convenient to construct the post into upper and lower halves, with the bottom end of the upper half and the top end of the lower half being secured in corresponding portions of the bore. A knuckled nut 260 with a conical bottom is threaded on portion 230. When the nut is tightened, both the nut and portion 210 are squeezed against block 240, preventing bars 190 and 200 and thus preventing the disc from tilting. When the nut is loosened, the disc can be disposed horizontally at right angles to the post or can be tilted at any vertical angle from −X to +X with respect to the post where X is less than 180 degrees of arc. It is also possible by loosening the nut sufficiently to disconnect the bars 190 and 200 from the disc and then to remove the disc from the remainder of the structure, by unscrewing knob 50.

Once the disc is removed, the rails can be adjusted to desired depths of penetration into the tracks, the marker means can be locked in place, and the device with the disc removed can be used as a compass to draw circles on a sheet of paper 40. To this end, the post is held vertically by knob 50 with pins 30 stuck into the paper (which rests on a table or other horizontal support) and handle 150 is swung in a horizontal circle about the post. The diameter of the circle to be drawn is of course determined by the relative positions of the tracks, rails and marker means.

With the disc replaced on the device and locked into horizontal position, the rails and tracks are locked together in a position at which the outer periphery of the disc just clears the surface of roller 130. Circles can be drawn as before, with the marker means being disposed as desired. Such a circle is shown at C in FIG. 4.

However the invention can also be used to draw ellipses when the disc is tilted to some vertical angle. This action is based upon a well known result of projective geometry which is as follows. When a circle is projected upon a surface paralleled to the circle, the projection will be circular, while if the surface is not so parallel but instead is tilted at some angle other than 90 degrees and less than 180 degrees, the projection will take the form of an ellipse. Once the disc has been locked in place at some angle of tilt with respect to the post, the various locking screws are loosened to enable the rails and tracks to be movable vertically and horizontally with respect to disc and post. The pins 30 are pushed into the paper as before with the user holding the post vertical by knob 50. The user then swings handle 150 in a closed horizontal loop about knob 50 with the roller 130 engaging the outer periphery of the disc at all times. The marker will then trace out an ellipse as shown at B or A in FIG. 4 The position of maximum horizontal separation between the post 20 and the marker means (with the disc periphery engaged by roller 130) is equal to one half the length of the major axis of the ellipse. The angle (2) of tilt is used to determine the length (L) of the minor axis by means of the formula L is equal to 2R cosine 2 where R is the outer radius of the disc.

Figure 5:
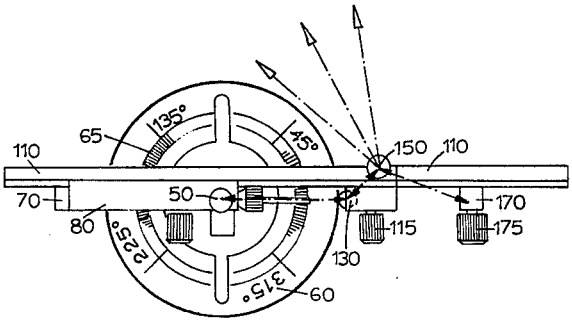
FIG. 5 is a top view of the invention.

The center of the post 10 is disposed on the same straight horizontal line as the centers of roller 130 and marker 170. Knob 150 is disposed forward of this line, as shown in FIG. 5 whereby a force of compression between knobs 50 and 150 is automatically established by keeping roller 130 in engagement with the outer periphery of the disc. This makes the device easier to operate as well as enhancing the accuracy of the resultant drawing.

Since there can be relative vertical and horizontal motion of the rails, tracks and marker with respect to the disc and post thus minimizing distortion particularly when high accuracy is desired and the paper surface is somewhat irregular.

Element 130 need not be a roller but can be any structure which can act as guide means to engage the periphery of the disc.

An additional vertical knob can be secured to the top of the marker means to provide better control when larger figures are to be drawn.

The disc can have a horizontal circular scale calibrated in degrees from 0 to 360 to enable the discontinuities of the locus of points on a circle to be translated to the same locus of points on a corresponding ellipse.

As shown in FIGS. 1 and 5, the disc has two diametrically opposite radially expending slots 185 extending from the inner periphery toward (but not reaching) the outer periphery. These slots permit installation and removal of the bars 190 and 200 and also accommodate the post when the disc is tilted, thereby increasing the maximum angle of tilt.

The angle of tilt of the disc can be set by moving the adjacent edge of the disc into alignment with the desired angular reading on scale 75.

What is claimed is:

1. A drawing instrument comprising:

a vertical post;

a circular annular disc having an enlarged central opening, said post passing through the center of the disc;

manually adjustable means removably securing said disc to said post, said adjustable means permitting the angle between the plane of the disc and the axis of the post to be set at any valve between X and −X, where X as expressed in degrees can range between 0 and somewhat less than 180;

a first elongated vertical member having a central section in the form of a semicircle with horizontally elongated upper and lower hollow tracks at corresponding upper and lower ends of the section extending in the same direction and coplanar with the section, said post passing through said ends and tracks with clearance whereby said member can be moved vertically up and down with respect to the post and can also be rotated about the post;

a second elongated vertical member having a straight vertical central section provided with a guide mechanism separated therefrom and engagable with and disengagable from the outer periphery of the disc, said member having parallel horizontal upper and lower rails at corresponding upper and lower ends of the straight section, each of the rails slidably engaging a corresponding one of the tracks, said rails being horizontally movable in said tracks;

and marker means slidably engaging the lower rail and securable thereto.

2. The instrument of claim 1 further including a vertical knob removably secured to the top end of the post and a block having downwardly extending pin means and secured to the bottom end of the post below said rails and tracks.

3. The instrument of claim 2 wherein the pin means includes two spaced vertical pins, the axis of the post being centered between said pins.

4. The instrument of claim 2 wherein said mechanism has a vertical axis, said marker has a vertical axis, the centers of said vertical axes of the mechanism and marker and the center of the post axis being disposed on a common straight line, said instrument including a second vertical knob secured to the upper rail and having a center disposed forward of said line.

5. The instrument of claim 2 wherein said disc has two diametrically oppositely disposed slots, each slot extending from the inner periphery along a radius to a point intermediate inner and outer peripheries.

6. The instrument of claim 1 wherein said straight section is secured at its top end to an end of the upper rail and is secured at its bottom end to the lower rail at a point intermediate the ends thereof.

7. The instrument of claim 1 wherein said post has separate upper and lower halves, said adjustment means including two diametrically opposed and radially inwardly extending bars disposed in the opening of the disc, each bar having an outer end with a slot engaging the inner periphery of the disc, and an integral structure disposed between and engaging the inner ends of the bars as well as engaging the lower end of the upper half of the post and the upper end of the lower half of the post.

* * * * *